US005553355A

United States Patent [19]

Baty

[11] Patent Number: 5,553,355

[45] Date of Patent: Sep. 10, 1996

[54] HANDLE FOR THE HANDICAP

[76] Inventor: Cheryll A. Baty, 2207 Bruton Rd., Plant City, Fla. 33565

[21] Appl. No.: 505,880

[22] Filed: Jul. 24, 1995

[51] Int. Cl.[6] ..... A47B 95/02

[52] U.S. Cl. ..... 16/110 R; 16/125; 220/755; 220/761

[58] Field of Search ..... 16/110 R, 124, 16/125, 112, 123; 312/244; 220/755, 761, 763

[56] References Cited

U.S. PATENT DOCUMENTS 4,301,935 11/1981 Gokcen et al. ..... 220/761

5,269,438 12/1993 Kelsey ..... 220/761

*Primary Examiner*—Chuck Y. Mah

[57] ABSTRACT

A handicap handle for allowing a handicap person to easily open and close drawers, doors or the like comprising a substantially round handle affixed to a base portion. The handle forming a substantially half circle opening for allowing a person's fist to fit therein. The handle and base portion are rotatable affixed to a protective cover that is installed into the drawer. The handle in a closed position is flush with the front surface of the drawer and in the open position exposes a protruding handle.

1 Claim, 3 Drawing Sheets

HANDLE FOR THE HANDICAP

BACKGROUND OF INVENTION

1. Field of the Invention

Generally, this invention is directed towards a handle for the handicap. More specifically, this invention provides a large opening type of handicap handle that will allow a person's fist to fit therein thereby eliminating the need for fingers to grab onto a conventional type of handle.

2. Description of the Prior Art

Generally, many cabinet drawers and the like utilize round knobs or handles with small openings for fingers to fit therein. These knobs and handles are designed for the average person capable of using his fingers to grab onto the knob or handle and thereby open the drawer.

The problem arises for handicapped persons having no fingers to grab onto a knob or handle like device. Normally, if a person is unable to grab onto the knob or handle of a drawer, the person is unable to open the drawer without help from an additional person.

Several approaches have been provided for the aiding of handicap persons in opening drawers, doors and the like. In U.S. Pat. No. 4,706,598, "A handle especially convenient for arthritics or handicapped persons that includes two hingedly connected sections that close together to mate with and engage an object received between ends of the sections remote from their hinged connection. When the sections are closed, the hinged ends thereof define a handle. The sections can be releasably secured in their closed relation."

In U.S. Pat. No. 5,314,221, "A ball and socket arrangement for aiding the handicapped or persons having limited reach or mobility and including one of a plurality of socket elements secured to an object which is to be moved and which is engageable by means of a manually grippable wand including an elongated handle having a ball at one end which is adapted to engage the socket to apply either a pulling or a pushing force thereto and wherein the angle and orientation of the sockets varies depending upon the object to which the socket is attached and which may be, for example, a drawer, door, slidable shelf, or the like."

In the art taught by U.S. Pat. No. 4,484,788, "A flush drawer handle for a drawer having at least a flat metal frontal wall portion about the handle comprises a handle slot having opposed horizontal edges and end edges. Flanges are provided in at least opposed ones of the horizontal edges and formed integral with the frontal wall portion and extending inwardly of the frontal wall. A rear wall member is also provided and defines a rear wall portion and side wall portions extending transverse to a common side of the rear wall portion. The side wall portions have retention tabs for releasable securement with the flanges."

In U.S. Pat. No. 5,231,733, and "Apparatus for grasping circular knobs which may be attached to drawers or doors of cabinets or the like including a generally dome-shaped grasping element having a handle attached thereto and extending outwardly therefrom. The internal surface of the generally dome-shaped element includes a series of internal shoulders of various diameters for the purpose of grasping knobs of various sizes so that the handicapped person may more easily manipulate the drawer or door to which the knob is attached."

While some of the prior art may contain some similarities relating to the present invention, non of them teach, suggest or include all of the advantages and unique features of the handicap handle as the invention disclosed herein.

SUMMARY OF THE INVENTION

The present invention is directed towards allowing a handicapped person to open and close drawers, doors and the like in an easy and quick fashion. The invention utilizes a rotatable handle that is easily graspable by persons not having fingers. A rotatable handle is used that will accept the fist of a person from either the left or right direction to open the drawer. The rotatable handle easily rotates to a closed position thereby making the handle surface flush with the surface of the drawer.

Accordingly, it is an object of this invention to provide a handicap handle that will allow a person not having fingers to grab onto the handle and open a drawer, door or the like.

Another object of this invention is to provide a handicap handle that will allow a person to grab onto the handle from multiple directions.

Still another object of this invention is to provide a handicap handle that will rotate and become flush with the front surface of the drawer or door.

Still yet a another object of this invention is to provide a handicap handle having a protective cover to prevent the rotating handle from becoming entangled with the contents of the drawer such as clothing articles and the like.

BRIEF DESCRIPTION OF THE DRAWINGS

This invention, together with other objects, features, aspects and advantages thereof, will be more clearly understood from the following description, considered in conjunction with the accompanying drawings.

Three sheets of drawings are furnished, sheet one contains FIG. 1, sheet two contains FIG. 2 and FIG. 3, and sheet three contains FIG. 4 and FIG. 5.

DESCRIPTION OF THE PREFERRED EMBODIMENTS

Figure 1:
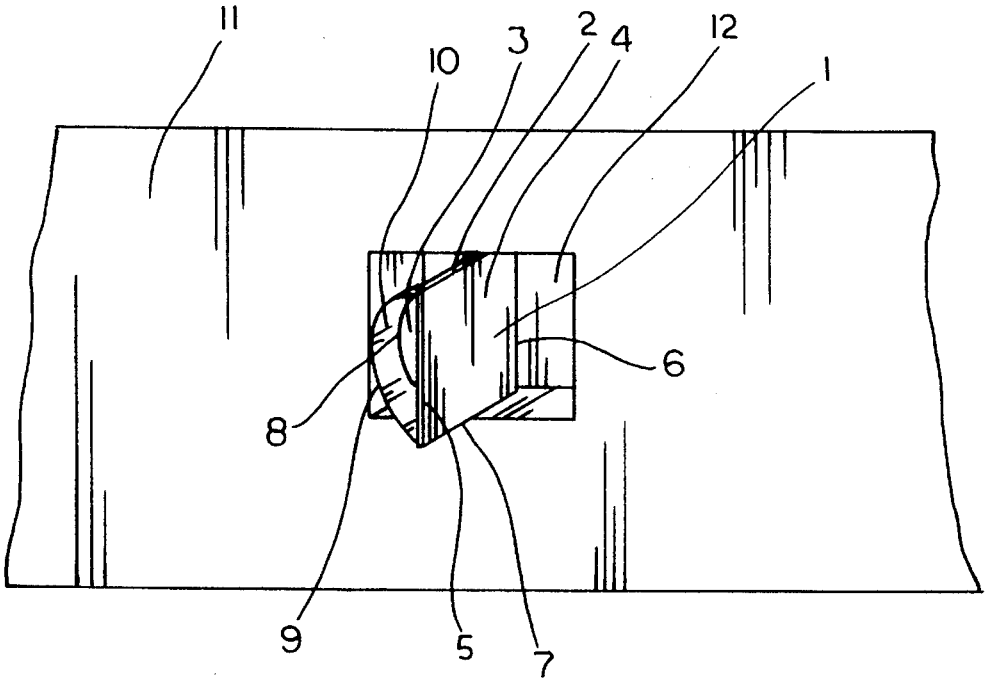
FIG. 1 is an orthographic view of the handicap handle installed to the front of a drawer in a semi open position.

Referring now to FIG. 1, an apparatus for allowing a disabled person to open and close drawers, doors and the like referred to generally by reference numeral 1. The apparatus is shown in FIG. 1 affixed to the front portion of a drawer 11 with the handle portion in a semi open position exposing the inside portion of the protective cover 12. The apparatus 1 is made up primarily of a handle base 2, a handle 16, with handle opening 3, and protective cover 18.

Figure 2:
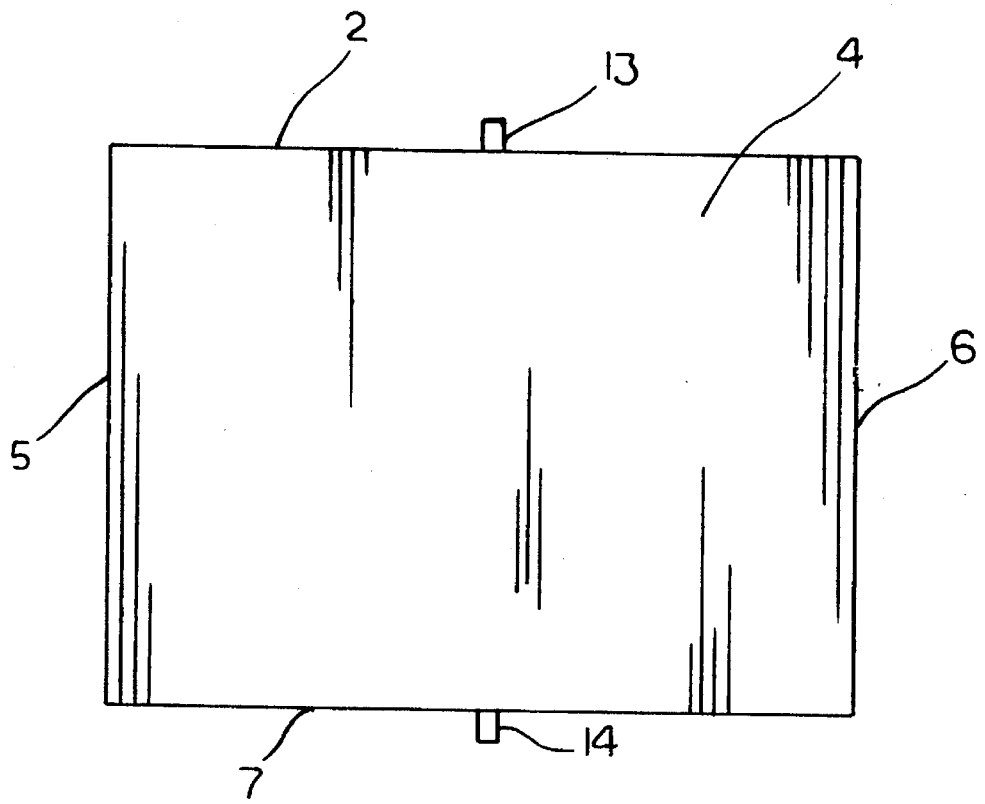
FIG. 2 shows a front view of the handicap handle with the dual pivot pins protruding thereof.
Figure 3:
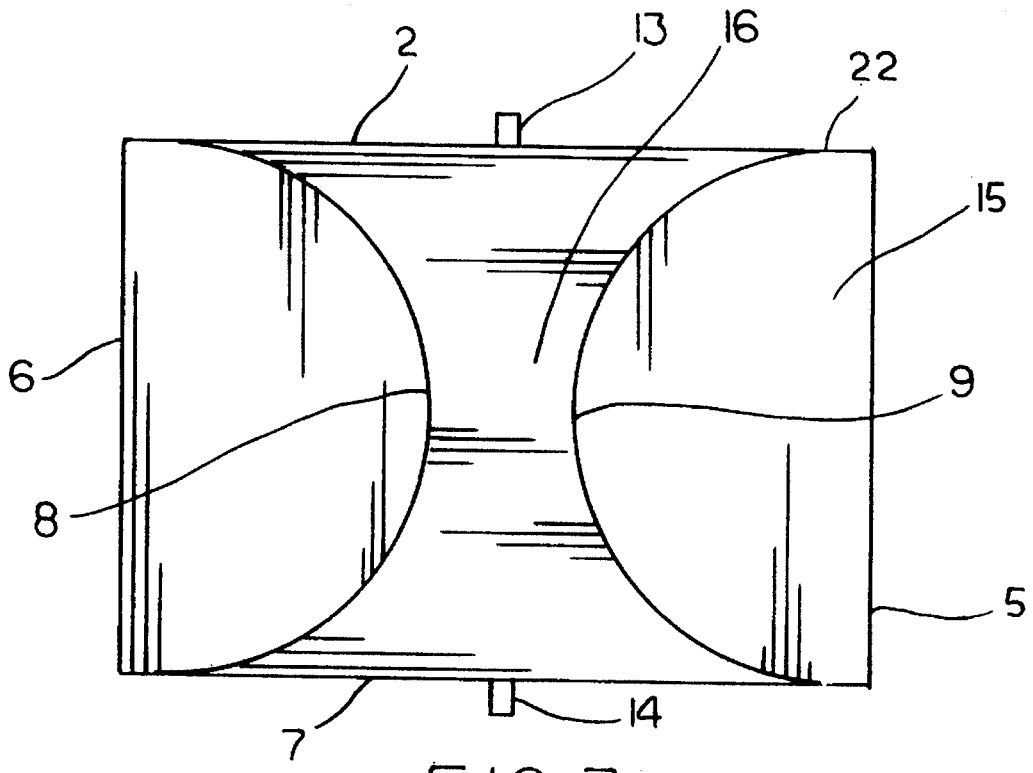
FIG. 3 shows a rear view of the handicap handle exposing the handle portion.

In FIG. 2 and FIG. 3, the handle base 2 is shown substantially rectangular in construction wit a front surface 15, a rear surface 4, and four edges 5, 6, 7, and 22. It should be noted that the handle base portion 2 is not limited to a rectangular construction only but could be made of various configurations. The handle base 2 supports the handle portion 16 and contains a pair of pivot pins 13 and 14. The pivot pins 13 and 14 are inserted into the protective cover 18 and allow the handle base 2 to be rotatably affixed to the protective cover 18.

Also shown in FIG. 3 is the handle 16 affixed to the front surface 15 and extends outwardly in a substantially curved fashion forming a substantially half circle handle opening 3. The handle 16 contains two curved edges 8 and 9 that allow a person fit more easily into the handle opening 3.

Figure 4:
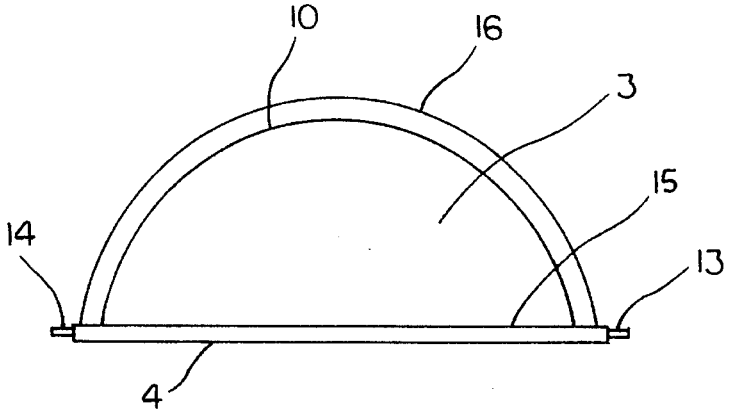
FIG. 4 shows a side view of the handicap handle showing the opening of the handle portion and the handle base.

Referring now to FIG. 4, we see a side view of the handle 16 affixed to the handle base 2. The inside surface of the handle 10 encloses the handle opening 3 in a substantially half circle configuration. This large opening 3 allows a person's fist to more easily fit therein.

Figure 5:
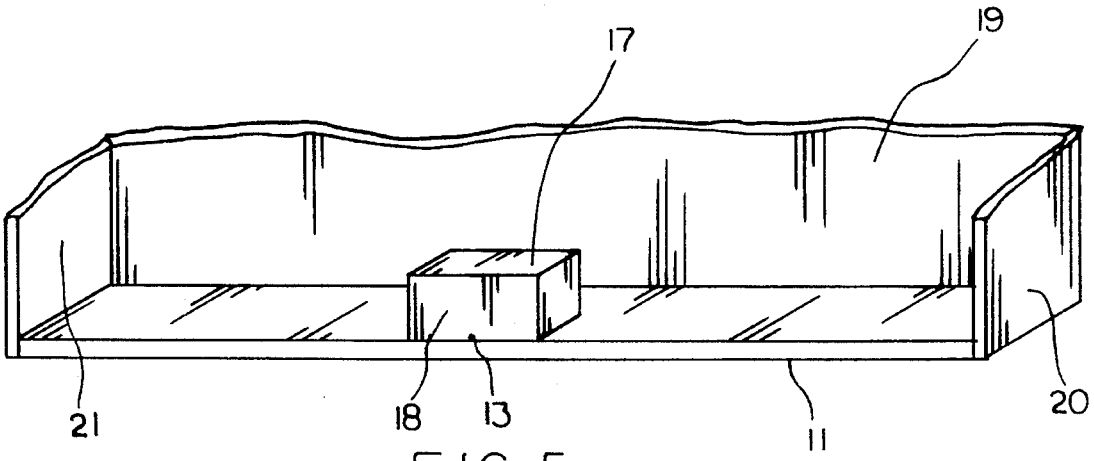
FIG. 5 shows an orthographic cutaway view of the protective cover installed on the inside of a drawer. The protective cover being affixed to the inside portion of the font of the drawer.

Referring now to FIG. 5, we see the back view of a drawer 19 with the protective cover 18 affixed to the rear side of the front the drawer 11. The drawer 19 having lateral walls 20 and 21. The protective cover 18 is shown with one of the pivot pins 13 protruding therethrough. The protective cover 18 is shown in a substantially box like configuration with rear surface 17 but can be made in various formation as long as the handle 16 and base portion 2 are allowed to rotate freely therein.

In carrying out this invention in the illustrative embodiment thereof, a person can normally construct the apparatus 1 in the following manner. First an opening is made in the drawer or door in which the handicap handle is to be installed. The opening should be made in the same dimensions such that the protective cover 18 can slide therein. The preassembled handicap handle 16 along with the protective cover 18 is then slid into the opening and affixed to the drawer by means of either glue or nails.

Conveniently, the handicap person pushes onto the rear surface 4 of the handle base 2 to rotate the handle 16 to the front side of the drawer. The handicap person then inserts his fist into the handle opening 3 and pulls the drawer open.

Accordingly, a very unique, attractive, and convenient apparatus are provided for a handicap handle to allow a disabled person to easily open and close a drawer, door or the like.

Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit and scope of this invention as claimed in the following claims and reasonable equivalents to the claimed elements.

What is claimed is:

1. A handicap handle for allowing disabled persons to open drawers and the like comprising:

(a) a substantially rectangular base portion having a front surface, a rear surface, a top edge, a bottom edge, and two side edges, (b) a handle affixed to the front surface of said rectangular base having a substantially curved construction forming half circle opening between said handle and said base, (c) a pair of pins affixed to said top and bottom edges of said base, (d) a protective cover rotatably affixed to said pins, said protective cover having a substantially box like construction thereby allowing said rectangular base to rotate therein, said protective cover having means of being affixed to a drawer or the like.

* * * * *